United States Patent [19]

Dougherty et al.

[11] 4,412,094

[45] Oct. 25, 1983

[54] COMPOSITELY INSULATED CONDUCTOR RISER CABLE

[75] Inventors: Timothy S. Dougherty, Roswell; John J. Kissell, Dunwoody, both of Ga.; Glenn L. Schmehl, Kingsville, Md.

[73] Assignee: Western Electric Company, Inc., New York, N.Y.

[21] Appl. No.: 287,620

[22] Filed: Jul. 28, 1981

Related U.S. Application Data

[63] Continuation-in-part of Ser. No. 151,854, May 21, 1980, abandoned.

[51] Int. Cl.[3] ..... H01B 7/34

[52] U.S. Cl. ..... 174/110 F; 174/34; 174/107; 174/110 V; 174/121 A

[58] Field of Search ..... 174/34, 36, 110 F, 107, 174/110 V, 121 A

[56] References Cited

U.S. PATENT DOCUMENTS 3,209,064 9/1965 Cutler ..... 174/36
3,644,659 2/1972 Campbell ..... 174/36 X
4,058,669 11/1977 Nutt et al. ..... 174/110 F X
4,174,236 11/1979 Dougherty et al. ..... 174/110 F X
4,262,164 4/1981 Nutt et al. ..... 174/34

FOREIGN PATENT DOCUMENTS 2626497 12/1977 Fed. Rep. of Germany ... 174/110 F
53-95290 8/1978 Japan ..... 174/110 F

*Primary Examiner*—R. R. Kucia
*Attorney, Agent, or Firm*—E. W. Somers

[57] ABSTRACT

A cable which is suitable for use as a riser cable in buildings comprises a plurality of conductors each of which is covered with a composite insulation. The composite insulation comprises an inner layer of an expanded polyethylene material and an outer layer of a polyvinyl chloride material with the percent expansion of the inner layer and the thickness of the outer layer being such as to optimize several cable parameters. The resultant cable is one which has excellent fire-retardant properties such as, for example, an unusually low fuel content. Advantageously, this same cable lends itself to color coding for inside wiring and is capable of having a relatively high pair count density. All these parameters are optimized within the framework of specific transmission requirements.

8 Claims, 12 Drawing Figures

COMPOSITELY INSULATED CONDUCTOR RISER CABLE

CROSS-REFERENCE TO RELATED APPLICATION

This application is a continuation-in-part of copending application Ser. No. 06/151,854 filed May 21, 1980 now abandoned.

TECHNICAL FIELD

This invention relates to a compositely insulated conductor riser cable which is suitable for use in buildings. More particularly, it relates to a riser cable which includes a greater number of conductor pairs within a given cross-sectional area and a lower fuel content than prior riser cables, and to one which is capable of being color-coded.

BACKGROUND OF THE INVENTION

Telephone service within buildings is provided by riser cables which generally extend from vaults in basements to the floors above. Because of the environment in which these riser cables are used, they must meet specified requirements which relate to fire-retardancy. One measure of fire-retardancy is a parameter which is known as the limiting oxygen index. That parameter is a function of the materials which comprise the cable, their surface areas and their structural arrangement. Another parameter, fuel content, is intended to mean that quantity of fuel which is released by the materials comprising the insulation and the jacketing after a fire starts.

Typically, a riser cable includes a core having a plurality of twisted pairs of conductors which are individually enclosed wih a composite unexpanded insulation comprising a polyvinyl chloride skin that is extruded over a solid polyethylene inner layer. The twisted pairs of conductors are enclosed in a sheath which is identified by the acronym ALVYN. The ALVYN sheath comprises a polyvinyl chloride jacket that is bonded to a corrugated aluminum shield.

The just-described insulation structure combines the acceptable fire-retardant characteristics of polyvinyl chloride and the superior dielectric constant of polyethylene. As a result, riser cables having required transmission characteristics such as a mutual capacitance of 52 nf/kilometer can be achieved within a reasonable cable diameter range. However, this insulation which contains approximately 50% polyethylene by weight is relatively high in fuel content.

Another consideration is the pair count density, which is the number of insulated conductors in a given cable cross-section. With the trend toward larger and larger buildings and the increased use of the telephone for various kinds of communication, the pair count density within a building riser system generally must be greater than that achieved in the past.

Also of importance to building cables is the capability of color coding the conductor insulation. Typically, a predetermined number of conductor pairs are grouped together in what is referred to as a unit. The unit is characterized by unique color combinations among the pairs as well as a binder having a particular color. This allows an installer to be able to identify a particular conductor pair and to distinguish between tip and ring.

As a result of the relative ease of identification, splicing and termination costs are greatly reduced.

A number of jacket and insulation systems are well-known in the art, but none that are known meet all the above-mentioned requirements. For example, it is known that polyvinyl chloride is a fire-retardant material, and that polyethylene has an excellent dielectric constant which is helpful to the transmission qualities of the cable. Expanded polyethylene has a lower dielectric constant which leads to the optimization of the cable size and which is somewhat thermally insulating, that is, it limits fire spread. Pulp insulation lends itself well to high pair density cable systems, but it does not lend itself to the color coding scheme which is desired for inside wiring and splicing.

As for the prior art, O. G. Garner U.S. Pat. No. 3,378,628 discloses a dual insulated telephone wire which is suitable for use in outside plant cables as well as inside buildings. The insulation comprises an inner layer of solid or expanded polyethylene while the skin is disclosed to be a fire-retardant material such as polyvinyl chloride. While the patent identifies alternate insulation systems for use in riser cables, it does not address the multi-faceted problem that must be overcome today. For example, a less than complete consideration of all the parameters which are involved could result in a cable design having an un acceptably high fuel content which exacerbates rather than solves the problem.

What is needed is an insulation and jacketing system which minimizes the opportunity for the beginning of a fire along a riser cable, and should such a flame be initiated, one which minimizes the propagation of the flame and the total heat which is released by the cable system. Also, the conductors must have a relatively small diameter-over-dielectric in order to reduce the outside diameter of the cable, but must also exhibit acceptable transmission characteristics. Lastly, the outer insulation must lend itself to a color coding scheme in order to facilitate inside wiring and splicing. Seemingly, these needs have not been met by the prior art including the Garner patent.

SUMMARY OF THE INVENTION

The foregoing needs which must be met in an economical manner in order to satisfy various building codes in today's environment are met by the cable of this invention. A cable of this invention is characterized by a predetermined mutual capacitance and includes a core having a plurality of individually insulated conductors with each of the conductors being enclosed by a composite expanded insulation. The composite expanded insulation includes an inner layer which comprises a polyolefin plastic material expanded to a predetermined percent and an outer insulation layer which comprises a relatively fire-retardant plastic material. The core is enclosed in a corrugated metallic shield and an outer jacket which is made of a fire-retardant material. In a preferred embodiment, the composite insulation comprises an inner layer of expanded polyethylene material and an outer layer of polyvinyl chloride.

Inasmuch as the prior art design of a polyvinyl chloride skin over a solid polyethylene inner layer provides satisfactory performance in terms of limiting oxygen index, the cable of this invention must provide equivalent performance while having a reduced size and fuel content. In order to accomplish this, the ratio of the weight of the outer layer to the total weight of the composite expanded insulation per unit length of conductor is at least a predetermined value. That weight ratio value is that of a cable having the predetermined mutual capacitance and comprising a plurality of equal gauge size conductors each of which is covered with a composite unexpanded insulation having an unexpanded inner layer of the polyolefin plastic material and an outer layer of the relatively fire-retardant material. As a result, the composite expanded insulation has a limiting oxygen index which is substantially equal to that of the composite unexpanded insulation. Also, the insulation of the cable of this invention has a fuel content and an outer layer thickness each of which has a minimum value for a composite expanded insulation having at least said predetermined weight ratio and an expansion that does not exceed said predetermined percent. Additionally, the composite expanded insulation provides the capability of having an optimum pair count density within a given cross-sectional cable size as well as the capability for color coding the individually insulated conductors.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figure 1:
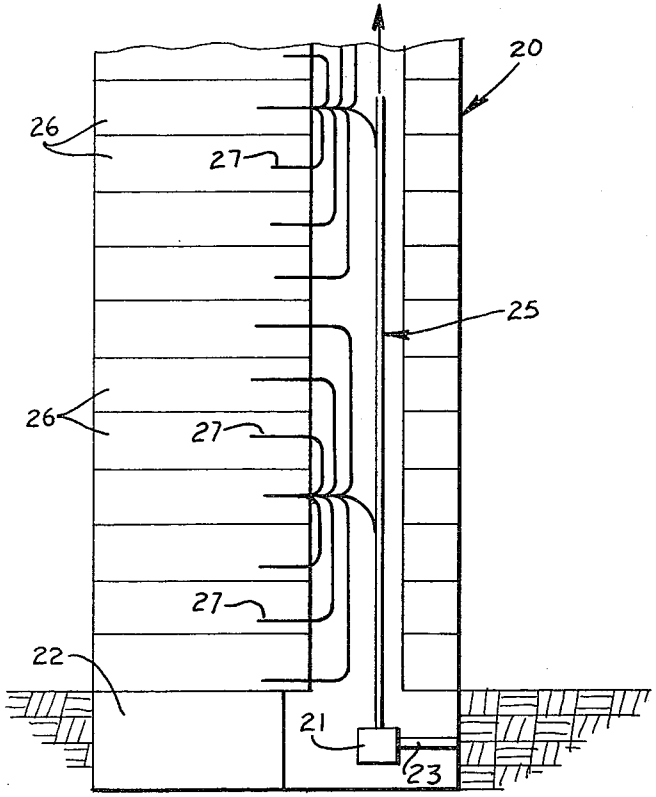
FIG. 1 is an elevational view partially in section of a building showing a cable distribution network to various floors.

Referring now to FIG. 1, there is shown a cross-sectional view of a building 20 which includes a cable vault 21 in a basement portion 22 thereof. An exchange cable 23 is routed into the cable vault 21 with individual riser cables 25—25 of this invention being routed vertically upwardly. At each of selected floors 26—26, distribution cables 27—27 which are also made in accordance with this invention are fed off the riser cables 25—25 in order to provide telephone service. A typical installation may include a 2700 conductor pair riser cable with 300 pair distribution cables being fed therefrom.

Figure 2:
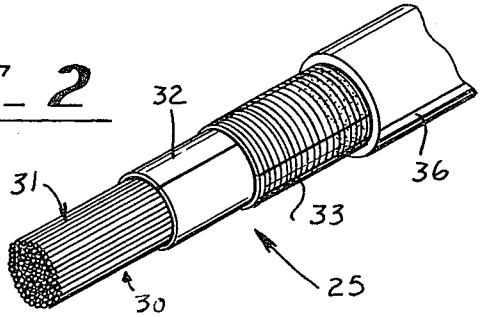
FIG. 2 is a perspective view of a cable of this invention which includes a plurality of individually insulated conductors having a low fuel content.

Referring now to FIG. 2, there is shown a cable 25 of this invention which includes a core 30 having a plurality of individually insulated conductors 31—31. The core 30 is enclosed in a wrap 32, and a corrugated aluminum shield 33 having a copolymer material coated on outwardly facing surface thereof. The copolymer material on the corrugated aluminum shield 33 causes the shield to be bonded to a jacket 36 which is made of a polyvinyl chloride (PVC) material that is substantially fire-retardant.

Figure 3A:
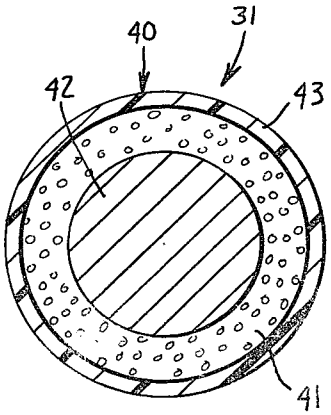
FIGS. 3A and 3B are cross-sectional views of a conductor of this invention showing a composite insulation cover which comprises an expanded inner layer and a solid skin, and of a prior art riser cable.
Figure 3B:
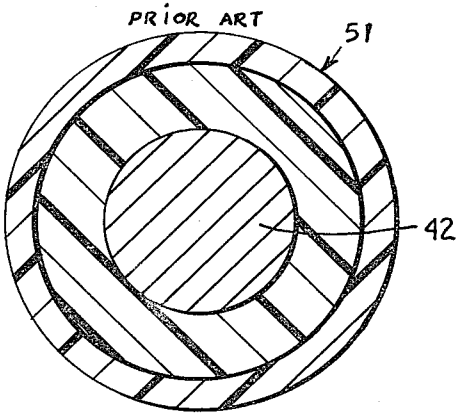

Each of the individually insulated conductors 31—31 in the cable 25 shown in FIG. 2 includes a composite insulation designated generally by the numeral 40 (see FIG. 3A). The composite insulation 40 replaces an insulation 51 which is shown in FIG. 3B and which includes an inner layer of solid polyethylene covering a copper conductor 42 and an outer layer of polyvinyl chloride.

The composite insulation 40 of this invention includes an inner layer 41 of expanded polyethylene which surrounds the copper conductor 42 in order to provide a concentrically disposed insulation cover. The composite insulation 40 also includes an outer layer or skin 43 which is comprised of a plasticized polyvinyl chloride material. In a preferred embodiment, the plasticized polyvinyl chloride may be one which includes for example at least about 72 parts by weight of polyvinyl chloride with the other 28 parts by weight including ingredients such as for example a plasticizer and other materials which strengthen and add particular properties to the insulation. Such a polyvinyl chloride insulation is well-known. Advantageously, the plastic skin 43 lends itself to color coding to facilitate inside wiring and splicing. As will be recalled, the lack of this capability is one of the drawbacks of pulp insulation.

The cable 25 of this invention is characterized by excellent fire-retardant properties. As will be recalled, limiting oxygen index (LOI) and fuel content are properties which are important with respect to flame spread and smoke evolution. The priorly used riser cable which included a PVC skin over a solid inner layer had an LOI of 26%.

Different materials give off different amounts of heat when subjected to flame and this is measured by the fuel content. Polyethylene, for example, has a higher fuel content than polyvinyl chloride and therefore adds more fuel to a fire than the PVC. Since cellular polyethylene such as that which comprises the layer 41 includes air cells, there is less material to fuel a fire. Not only is the cellular polyethylene less dense than its solid polyethylene predecessor, but the diameter-over-dielectric (DOD) is less than that of the PVC-over-polyethylene and this decreases the amount of material which could fuel the fire.

A first step in arriving at the structural arrangement of the composite insulation 40 is to construct the graphs which are shown in FIGS. 4–8. All these graphs are constructed for a 26 gauge size copper conductor having an inner layer 41 of polyethylene and an outer layer 43 of PVC. It should be understood that plots of the same general configuration would be had for other gauge sizes such as 22 and 24 which are common in communications installations.

Figure 4:
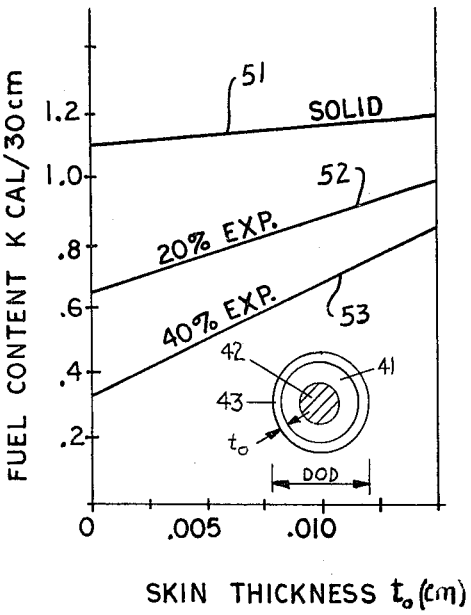
FIGS. 4–5 are graphs which show plots of various parameters of a particular gauge size riser cable against the skin thickness.
Figure 5:
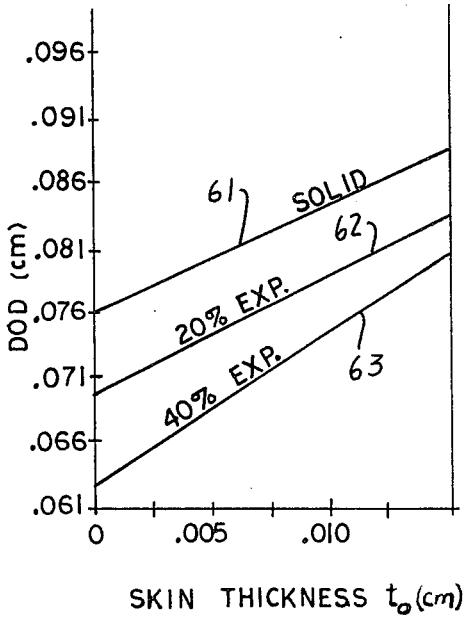

In order to determine what effect, if any, the expanded inner layer has on the fire-retardant properties of a riser cable, reference is made to the graph of FIG. 4. It shows a plot 51 of fuel content against the thickness, $t_o$, of the polyvinyl chloride layer 43 for an unexpanded inner layer and ones 52 and 53 for an inner layer 41 having 20% and 40% expansion. As is seen, the fuel content decreases significantly for a composite insulation having an expanded inner layer. Moreover, as is well-known from the prior art of expanded insulation and as is apparent from plots 61–63 in FIG. 5, an expanded insulation results in an insulated conductor having a reduced DOD.

Figure 6:
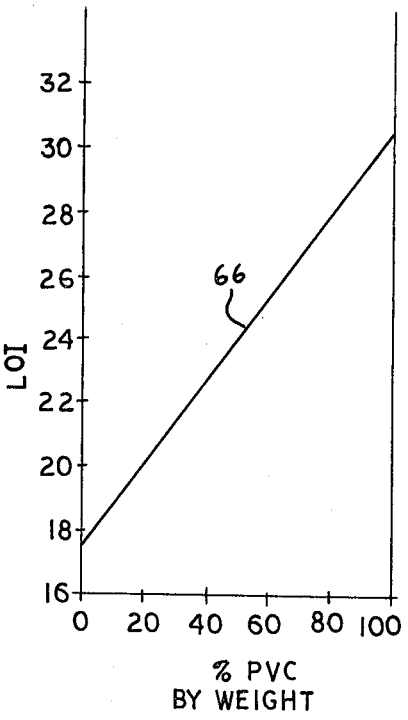
FIG. 6 is a graph showing limiting oxygen index (LOI) for a praticular gauge size conductor for different values of weight percent of a solid skin of a composite insulation.

Turning now to FIG. 6, there is shown a graph 66 of the limiting oxygen index (LOI) versus the weight content by percent of the polyvinyl chloride outer layer 43 in the composite insulation 40 for a 26 gauge size insulated conductor. At the left hand side of the graph, the percent PVC in the insulation is zero. This corresponds to a standard polyethylene insulation, for example, which is not desirable for riser cable use. The intersection of the plot with the 100% abscissa value depicts the LOI for an all polyvinyl chloride conductor insulation cable. While that LOI value is more than acceptable for a building environment, such a cable has unacceptable transmission characteristics because of the dielectric properties of polyvinyl chloride.

It will be recalled that the higher the LOI, the less susceptible is the insulation material to burning. For example, since there is about 21% oxygen in the atmosphere, an insulation material having a limiting oxygen index of 22%, cannot burn under ambient conditions. However, this should not be taken to be an absolute situation since air could be drawn into the vicinity of the cable which could help to fuel a fire.

The graph in FIG. 6 is helpful in determining the structural arrangement of the composite insulation 40 of the cable 25 of this invention. It is seen that in order to achieve a limiting oxygen index in the vicinity of 26%, which characterized the priorly used riser cable, the weight percent of polyvinyl chloride in the insulation should be in the range of about 60 to 70%.

In addition to the compositely insulated conductor 31 of this invention exhibiting an LOI about equal to that of the priorly used insulation, the inner layer 41 of expanded polyethylene inhibits the preheating of the copper conductor 42. If uninhibited, this preheating would augment the propagation of the flame along the insulated conductor 31. Since air acts an an insulator and since it can only be heated by conduction, the cellular insulation 41 effectively decreases the heat transfer by the copper conductors 42—42 which otherwise would contribute to the propagation of the fire within a building. This property of the composite insulation 40 of this invention is important because in building fires, the preheating of combustibles is one of the principal modes by which flames spread.

Also, it should be understood the LOI of insulation is only one measure of its fire-retardance capabilities. The limiting oxygen index is most useful in comparing the behavior of materials at the onset of a fire. Once the fire has begun, the release rate becomes an important parameter. Also, in a riser cable, the dripping of flaming insulation from an area of initial impingement must be considered. In a burn test of polyethylene, the insulation melts and the burning melt is seen to drip and to spread the flame. As a result, a cable which includes conductors insulated solely with polyethylene is unacceptable for use in the riser space since it may tend to fuel sections of the cable remote from the point of the flame. This may concentrate the materials which contribute to flare-up at a lower floor level and exacerbate the conflagration.

This problem is overcome by the cable 25 of this invention which includes the composite insulation 40 having the PVC skin 43. The burn test of such a cable shows that the PVC skin 43 chars. This contains the inner layer 41 which otherwise would melt and drip and thereby minimizes flame spread.

Figure 7:
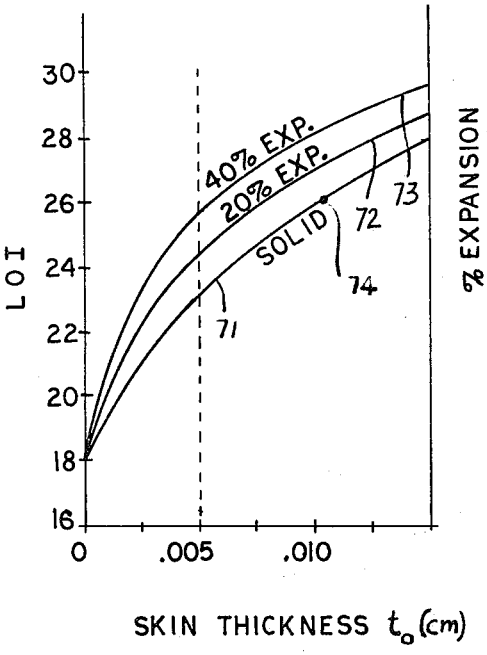
FIGS. 7–8 are graphs which show a plot of LOI versus skin thickness for a particular gauge size riser cable and percent expansion of the inner layerversus total insulation wall thickness.

Turning next to FIG. 7, there is seen a plot 71 of the limiting oxygen index against the polyvinyl chloride skin thickness $t_o$ for a composite insulation 40 having an unexpanded inner layer and ones 72 and 73 having a 20 and a 40% expanded inner layer 41. The prior art design is shown at point 74 on the plot 71 of zero expansion. Because of the lower dielectric constant of air over plastic, it is known that an expanded inner layer 41 will result in an insulated conductor 31 having a smaller outer diameter. For a conductor of zero polyvinyl chloride skin thickness, i.e., a totally polyethylene insulated conductor, the limiting oxygen index is unacceptably low no matter what the percent expansion.

Figure 8:
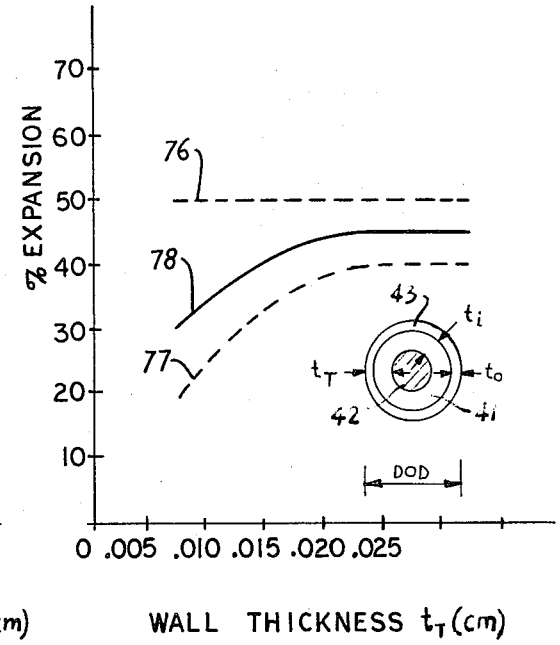

Once a decision has been made to use an expanded inner layer 41, it becomes necessary to establish a range for the percent expansion. The graph in FIG. 8 plots the percent expansion against the total insulation wall thickness, $t_T$, of the composite insulation 40. The upper broken line 76 defines the maximum expansion which can be used and result in acceptable cell structure. The region between the two broken lines 76 and 77 establishes the percent expansion for wall thickness within normal process variations. As can be seen, below a certain wall thickness, the normal variation increases because of the potential for variability in a relatively thin product. Consequently, the solid curve 78 in FIG. 8 which is the average percent expansion within the processing range decreases considerably for the relatively thin wall thickness.

An unexpected result occurs regarding the relative thickness of the inner and the outer layers 41 and 43, respectively of insulation. With PVC of the outer layer 43 having a fuel content of about 5.5 K Cal/gm and polyethylene of the inner layer 41, a fuel content of about 11.0 K Cal/gm, it is expected that the conductor 31 of a riser cable 25 would be insulated with a relatively thick outer layer of the PVC. However, because of the comparatively poor dielectric properties of PVC, any increase in the skin thickness for purposes of decreasing the fuel content requires an increase in the DOD of the insulated conductor 31 to offset the adverse electrical affects of the PVC. The net result is an increased DOD and hence an increased fuel content which is a result opposite to the one sought by adjusting the relative thicknesses of the layers.

Contrary to what would be expected, the fuel content of the conductors 31—31 and of the cable 25 is reduced by decreasing the skin thickness, $t_o$. This conclusion is conditioned on the desirability of optimizing several parameters such as transmission characteristics, fuel content, LOI and size of cables used for inside wiring. Of course, if fuel content and size were the only consideration, the DOD could be maintained constant and the thickness of the skin 43 increased.

Having considered individually the parameters such as fuel content, the problem of optimization is now addressed. This is done while keeping in mind that the cable 25 must meet specific transmission requirements such as a mutual capacitance of 52 nanofarads/kilometer, for example. The variable insulation parameters are the thickness, $t_o$, of the skin 43 and the percent expansion of the inner layer 41.

What may be the proper direction for one of the variable parameters in order to satisfy one cable requirement may not be advisable to satisfy others. For example, in order to minimize the DOD and the fuel content, the skin thickness must be minimized and the inner layer expansion must be maximized. However, to maximize the LOI, both the skin thickness and the percent expansion must be maximized. As for optimum mechanical properties, the skin thickness should be maximized while the inner layer expansion is minimized.

Figure 9:
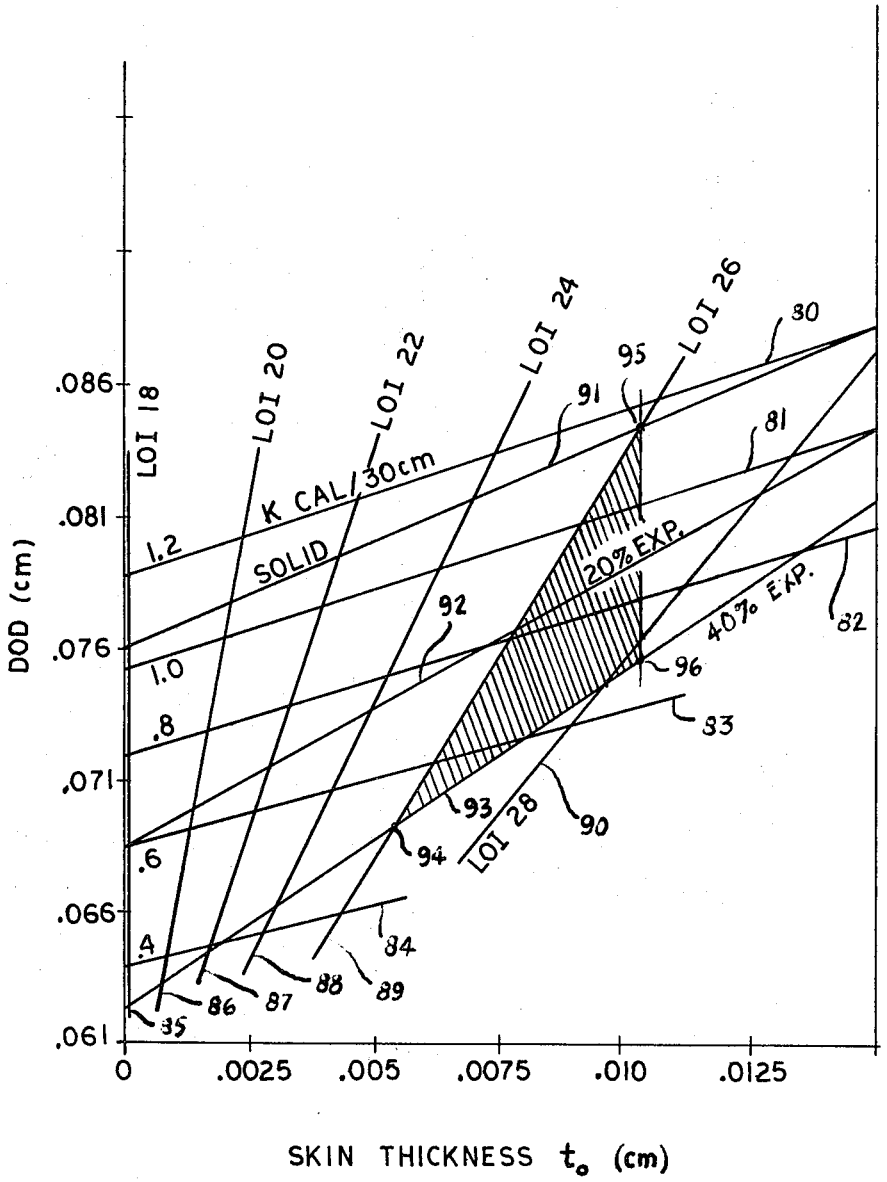
FIG. 9 is a graph which may be used to provide a cable design which optimizes the various cable parameters while meeting specific transmission requirements.

The optimization is defined with the assistance of the composite graph shown in FIG. 9. Lines 80–84 of constant fuel content, 85–90 of constant LOI and 91–93 of constant percent expansion of the inner layer 41 are all plotted with an ordinate of DOD and an abscissa of skin thickness, $t_o$. Any design combination on the graph results in a cable 25 having acceptable transmission characteristics of the predetermined mutual capacitance of 52 nanofarads/kilometer.

The cable 25 must provide equivalent performance in terms of limiting oxygen index to that of the prior art unexpanded composite insulation, which has been described hereinbefore, while having a reduced size and fuel content. Generally, the cable 25 is one which is defined within the hatched area of the graph shown in FIG. 9.

One of the boundaries of the hatched area is the line 89 which represents the plot of an LOI of 26%. The inventive cable must have an LOI which is equal to or greater than that of a cable having the predetermined mutual capacitance and comprising a plurality of equal gauge size conductors which are insulated with the hereinbefore described composite unexpanded insulated of a PVC skin over an unexpanded polyethylene inner layer. In order to achieve this, the weight ratio of the PVC outer skin 43 to the total weight of the insulation per unit length of conductor must be at least equal to that of the composite unexpanded insulation.

Another boundary of the hatched area in FIG. 9 is the line 93 which represents an expansion of 40%. As is seen, the line 93 intersects the line 89 of an LOI of 26% at a point designated 94.

Assuming a desired LOI of 26% and a maximum expansion in the range of 40–45%, the lines of constant LOI of 26% and expansion of 40% are traced to their intersection to optimize the fuel content and the DOD. A cable 25 including conductors 31—31 covered with a composite expanded insulation having optimum properties is one identified by the numeral 94 in the graph of FIG. 9. The ratio of the weight of the outer layer 43 to the total insulation weight per unit length of conductor is substantially equal to that of a cable having conductors insulated with a PVC skin over an unexpanded polyethylene inner layer. Also, as can be seen, that cable has an LOI of 26, a skin thickness of 0.005 cm, a DOD of about 0.069 cm and a very acceptable expansion of 40%.

Another unexpected result flows from an attempt to improve the fire retardancy of the riser cable. Heretofore, in the prior art such as for example in U.S. Pat. No. 3,378,628, improved fire retardancy was equated to an increase in the limiting oxygen index of an insulation material. It would therefore seem reasonable in order to acieve a size reduction to hold the thickness $t_o$ of the skin layer 43 constant and to expand the inner layer 41. This change is graphed in FIG. 9 as a vertical line from point 95 to point 96. As can be seen, the LOI is improved—it increases from 26 to 28%.

While this approach would be expected, its results are not the optimum results which are achieved by the cable 25 of this invention. The cable 25 of this invention not only achieves an acceptable LOI, although not as high as that achieved at point 96, and a suitable expansion of the inner layer 41, but it also achieves a still further size reduction and a lower fuel content.

The cable 25 of this invention is ideally suited for use as a riser cable inasmuch as it minimizes the DOD of the conductors 31—31 comprising the cable and the fuel content of the cable while meeting other requirements. These include an overall mutual capacitance and an expansion in a predetermined range. In cables which are used for inside wiring and which are made in accordance with this invention, the mutual capacitance is 52 nanofarads/kilometer and the expansion is 40 to 45%.

In a preferred embodiment of this invention for 22 gauge copper conductors, the diameter-over-dielectric of the total insulation is about 0.103 cm and the thickness, $t_o$, of the outer layer of polyvinyl chloride is about 0.005 cm. The expansion of the polyethylene which comprises the inner layer 41 of the composite insulation is about 45% with the percent polyvinyl chloride in the composite insulation being about 53%. In each one hundred kilometers, there are approximately 18 kilograms of polyethylene with each 7.62 cm diameter cross-section of cable being capable of including 1200 pairs of conductors.

For a 26 gauge size cable, the diameter-over-dielectric of the total insulation is about 0.069 cm while the skin thickness is the same as for the 22 gauge cable described above. The percent expansion is about 40%, the percent PVC in the insulation increases to about 63% and the kilograms of polyethylene per one hundred kilometers decreases to about 8. The 7.62 cm diameter cable cross-section is capable of including 3000 conductor pairs.

Figure 10:
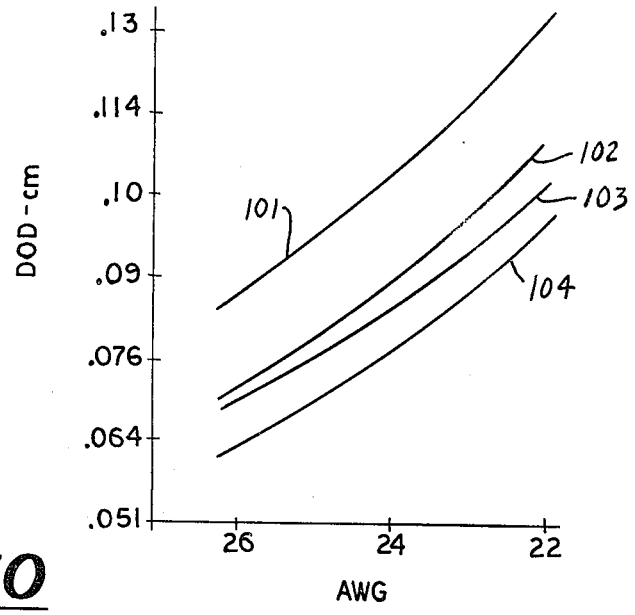
FIG. 10 is a graph of diameter-over-dielectric versus gauge size for a cable of this invention and for prior art cables.
Figure 11:
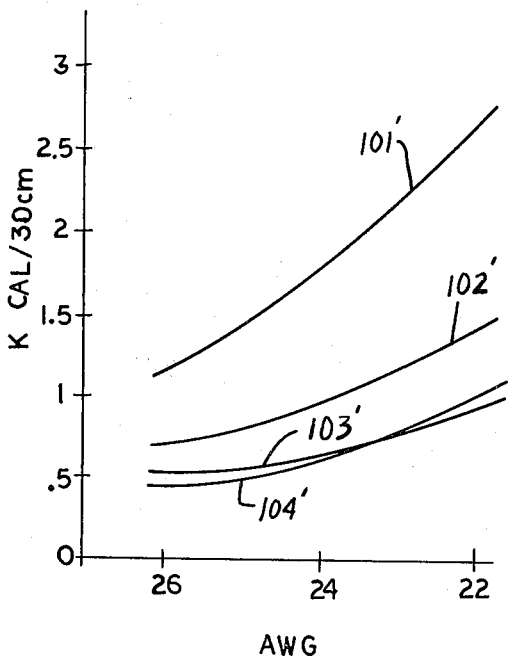
FIG. 11 is a graph of insulation fuel content for a cable of this invention and for prior art cables.

Turning now to the graphs shown in FIGS. 10–11, it will become obvious that the composite insulation 40 of this invention offers numerous advantages. FIGS. 10–11 include plots 101 and 101' of an insulation which comprises solid polyvinyl chloride over solid polyethylene and which is the currently used insulation, plots 102 and 102' of polyethylene insulation, plots 103–103' of the composite expanded insulation 40 of this invention, and finally plots 104–104' of an insulation of a cable designated DUCTPIC* cable. In DUCTPIC* cable, the term DUCTPIC being a trademark of Western Electric Company, Incorporated, the diameter-over-dielectric (DOD) in a given cable cross-section is optimized with respect to transmission characteristics. The last mentioned insulation system 104 comprises a 0.0038 cm skin made of high density polyethylene and an inner layer of polyethylene which as a percent expansion of about 35%.

Referring to FIG. 10, there is shown a graph of diameter-over-dielectric (DOD) in centimeters versus the gauge size (AWG) of the conductor 42 for each of the four above-identified insulation types. The DOD of an insulated conductor is determinative of cable diameter and the number of pairs is directly proportional to the cross-sectional area of the insulated conductor. Using the insulation 101 as a reference, the composite insulation 40 of this invention which is shown in the plot 103, has a diameter-over-dielectric of about 0.103 cm for 22 gauge which is about 80% and a cross-sectional area which is about 64% of that of the insulation of plot 101 having a DOD of about 0.130 cm. Only the insulation of DUCTPIC cable (plot 104) surpasses the size reduction with a DOD of 74% and an area of 55% of that of the reference insulation. Because the dielectric constant of the skin 43 of the composite insulation 40 of this invention is slightly larger than that of the skin of DUCTPIC cable, the DOD of this insulation is slightly larger than that of the DUCTPIC cable conductor. However, while its dielectric constant, $\epsilon_o$, is somewhat larger than that of DUCTPIC cable insulation because of the presence of the PVC skin, the cable 25 of this invention has transmission characteristics which are equivalent to those of DUCTPIC cable.

The decrease in pair count density over that afforded by DUCTPIC cable is not that significant when the other advantages of the cable 25 of this invention are considered. Not only is the pair density of a cable 5 of this invention higher than any except that of DUCTPIC cable, it optimizes the fuel content and limiting oxygen index (LOI) while at the same time providing the capability of being color-coded for positive pair identification.

Turning now to FIG. 11, there is shown a plot of the insulation fuel content in kilo calories per 30 centimeters versus the gauge size of the conductor 42. As can be seen, the fuel content for the insulation 40 of this invention, which is represented by the plot 103' compares favorably with that of the insulation of the so-called DUCTPIC cable (see plot 104'). Notwithstanding the use of the ALVYN sheath, it is lower by far than the fuel content of the insulation 101' which contains approximately 50% polyethylene by weight.

FIG. 9 taken together with FIGS. 10 and 11 would seem to indicate that the limiting oxygen index of the composite insulation 40 of this invention is optimized with respect to the fuel content as well as the size of composite insulation which provides a maximum number of pairs within a given cable cross-section. Of course, it should be realized that the DUCTPIC cable would optimize the number of pairs still further, but for other reasons it would not be suitable for riser cable. For example, inasmuch as DUCTPIC cable includes conductors which are polyethylene insulated, the limiting oxygen index is less than 21 which is not preferred for use in buildings.

It is to be understood that the above-described arrangements are simply illustrative of the invention. Other arrangements may be devised by those skilled in the art which will embody the principles of the invention and fall within the spirit and scope thereof.

What is claimed is:

1. A fire-retardant cable which is particularly suited for use within a building and which has a predetermined mutual capacitance, said cable comprising:

a core which comprises:

a plurality of conductors, each of said conductors being insulated with a composite expanded insulation which comprises:

an inner layer of a cellular polyolefin plastic material which has an expansion that does not exceed a predetermined percent; and an outer layer of a relatively fire-retardant plastic material, said outer layer being such that the ratio of its weight to the weight of said composite expanded insulation per unit length of conductor is at least equal to that of a cable having the predetermined mutual capacitance and comprising a plurality of said conductors each of which is covered with a composite unexpanded insulation comprising an unexpanded inner layer of said polyolefin plastic material and an outer layer of said relatively fire-retardant plastic material to cause said composite expanded insulation to have a limiting oxygen index which is at least equal to that of the composite unexpanded insulation and;

a fire-retardant sheath which encloses said core.

2. The cable of claim 1, wherein the thickness of said outer layer is less than the thickness of the outer layer of the composite unexpanded insulation and the expansion of said inner layer is the predetermined percent.

3. The cable of claim 1, wherein said composite expanded insulation has an outer diameter, a fuel content and an outer layer thickness each of which has a minimum value for a composite expanded insulation having at least said predetermined weight ratio and an expansion that does not exceed said predetermined percent, and which result in a cable having the predetermined mutual capacitance.

4. The cable of claim 3, wherein said polyethylene material is expanded to have a percent expansion in the range of about 40 to 45%.

5. The cable of claim 1, wherein the limiting oxygen index of said composite insulation is in the range of about 23 to about 26%.

6. The cable of claim 1, wherein said inner layer of said composite expanded insulation has a thickness of about 0.010 cm to 0.015 cm.

7. The cable of claim 6, wherein said outer layer of said composite expanded insulation has a thickness of about 0.005 cm.

8. The cable of claim 1, wherein said composite expanded insulation has a fuel content in the range of about 0.5 to 1 K Cal for each 30 cm of each said conductor.

* * * * *